United States Patent [19]

Wilson

[11] Patent Number: 4,611,741

[45] Date of Patent: Sep. 16, 1986

[54] BOOKLET FINISHING APPARATUS

[75] Inventor: William C. Wilson, Rochester, N.Y.

[73] Assignee: Eastman Kodak Company, Rochester, N.Y.

[21] Appl. No.: 694,544

[22] Filed: Jan. 24, 1985

[51] Int. Cl.[4] ..... B41L 43/12; B42B 5/00; B42C 9/00

[52] U.S. Cl. ..... 227/99; 412/37; 412/39

[58] Field of Search ..... 227/99; 412/37, 39; 270/53, 58; 355/14 SH

[56] References Cited

U.S. PATENT DOCUMENTS

| | | | |
|---|---|---|---|
| 2,973,199 | 2/1961 | Biel et al. | 412/39 X |
| 3,709,595 | 1/1973 | Turner et al. | 355/14 |
| 4,129,913 | 12/1978 | Pfaffle | 412/39 |
| 4,134,672 | 1/1979 | Burlew et al. | 355/14 |
| 4,237,568 | 12/1980 | Kunzmann | 412/39 X |
| 4,242,174 | 12/1980 | Snellman et al. | 412/37 X |
| 4,248,525 | 2/1981 | Sterrett | 355/14 SH |
| 4,281,920 | 8/1981 | Cross | 355/75 |
| 4,313,670 | 2/1982 | Caldwell | 355/3 R |
| 4,358,197 | 11/1982 | Kukucka et al. | 355/14 R |
| 4,473,425 | 9/1984 | Baughman et al. | 412/37 X |
| 4,511,297 | 4/1985 | Wilson | 412/37 X |

*Primary Examiner*—Robert L. Spruill
*Assistant Examiner*—Taylor J. Ross
*Attorney, Agent, or Firm*—G. Herman Childress

[57] ABSTRACT

Booklets are produced from sets of sheets fed seriatim to finishing apparatus from a copier/duplicator or the like either by adhesively binding the sheets together or by stapling them together. The finishing apparatus has first and second adhesive binders used for securing sets of sheets together with adhesive, and first and second stapler/finishers for securing sets of sheets together with one or more staples. The sets of sheets are directed alternately either to the first adhesive binder and to the second adhesive binder or to the first stapler/finisher and the second stapler/finisher. The finished booklets from the binders or the stapler/finishers are collected in a collection station. By providing two adhesive binders and two stapler/finishers booklets can be finished on an "on-line" basis at full machine speed and without interrupting the flow of sheets of a second booklet until the first booklet has been completely finished. In addition, if one finishing station is disabled, the apparatus can be used to produce booklets using the station that is not disabled.

2 Claims, 3 Drawing Figures

BOOKLET FINISHING APPARATUS

BACKGROUND OF THE INVENTION

This invention relates to apparatus for producing finished booklets using adhesive binders and stapler/finishers.

U.S. Pat. No. 4,473,425, issued Sept. 25, 1984, discloses apparatus for producing booklets from sets of sheets fed seriatim from a copier/duplicator or the like. The apparatus includes an adhesive binder and a stapler/finisher, and sets of sheets can be provided either to the binder or to the stapler/finisher depending upon the mode of operation selected by the machine operator. The apparatus for finishing booklets disclosed in U.S. Pat. No. 4,473,425 operates on an "on-line" basis. Therefor, all steps required for completing one booklet must be carried out prior to the time the first sheet of the next set of sheets reaches the area where the booklets are assembled. In order to provide sufficient time for completing the production of booklets in the finisher, the associated copier/duplicator can briefly stop production of copy sheets after each set of sheets. However, this requires the copier/duplicator to be operated at less than its maximum capacity. Alternatively, apparatus can be provided for momentarily interrupting the flow of the first sheet of a set of sheets to the assembly area in order to provide time for completion of the booklet being formed from a preceding set of sheets. Apparatus of this type is disclosed in commonly assigned U.S. Pat. No. 4,511,297, issued Apr. 16, 1985 from U.S. patent application Ser .No. 422,069, filed Sept. 23, 1982, in the name of W. C. Wilson et al and entitled "Apparatus and Method for Offsetting and Delaying Delivery of Sheets in an Adhesive Binder," and in the commonly assigned U.S. Pat. No. 4,134,672, issued Jan. 16, 1979 in the names of L. E. Burlew et al and entitled, "Copier Finisher for an Electrographic Reproducing Device." While apparatus for delaying the flow of the first sheet of a set of sheets works satisfactorily to solve this problem, it does require the implementation of additional apparatus in a binder or stapler/finisher.

Another problem that may occur when using an adhesive binder or stapler/finisher in combination with a copier/duplicator is that the apparatus for producing booklets can become temporarily disabled for a variety of reasons. When the finisher is not operative, there is a loss of productivity to the operator thereof and, if the finisher is leased, a loss of revenue to the leasor of the finisher. To some extent this problem is reduced with apparatus of the type disclosed in the before-mentioned U.S. Pat. No. 4,473,425 because the operator has a choice of producing booklets using either an adhesive binder or a stapler/finisher. However, it clearly could be more desirable to provide apparatus which could, at substantially anytime, allow the machine operator to produce booklets on-line either by using an adhesive binder or a stapler/finisher.

SUMMARY OF THE INVENTION

It is an object of the invention to provide apparatus for producing finished booklets which eliminates the need for providing time delay in producing a set of sheets until a preceding set of sheets has been finished, and which also eliminates the need for apparatus for delaying delivery of the first sheet of a set until the preceding set has been finished. Another object of the invention is to provide apparatus which will increase the utilization of the copier/duplicator and associated booklet apparatus even when part of the apparatus is in need of repair.

In accordance with the present invention, apparatus is provided for producing finished booklets from sets of sheets fed seriatim to the apparatus. The apparatus comprises first and second finishing stations, each of which has means for assembling a set of sheets and securing the assembled sheets together to form a booklet. Sheet paths lead to the first finishing station and the second finishing station, and means are provided for directing all sheets of a set of sheets to the first finishing station or to the second finishing station. A collection station receives the finished booklets, and finished booklets are delivered to the collection station from both the first finishing station and the second finishing station.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
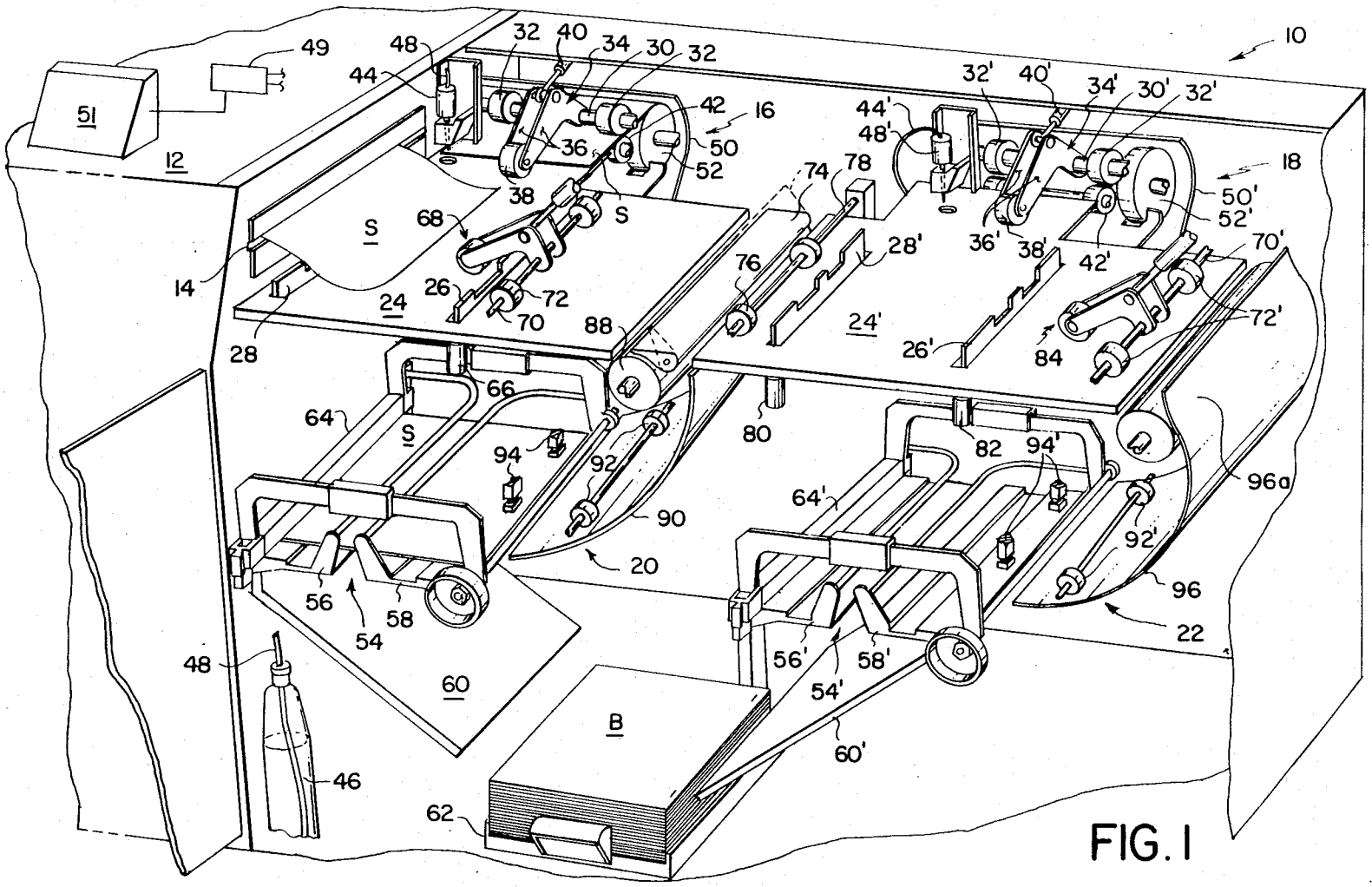
FIG. 1 is a fragmentary perspective view, partially broken away, illustrating booklet-producing apparatus of the present invention.

The apparatus for producing booklets in accordance with the present invention is generally designated "10" in FIG. 1. Parts of the apparatus 10 can be the same or substantially identical to the binding apparatus and method disclosed in the beforementioned U.S. Pat. No. 4,473,425. Other portions of apparatus 10 can be the same or substantially the same as the copier/finisher disclosed in the beforementioned U.S. Pat. No. 4,134,672. Accordingly, the disclosures of U.S. Pat. Nos. 4,473,425 and 4,134,672 are hereby incorporated by reference.

The sheets S that are to be formed into booklets can be received from an associated reproduction apparatus, such as a copier/duplicator or the like 12. Sheets S are received from the copier/duplicator through a slot 14. The sheets are received seriatim and in a predetermined page sequence order. For example, the sheets preferably are delivered so that the first sheet of a set received from the copier/duplicator contains the last page of information in a booklet and the last sheet of a set of sheets contains the first page of information in the booklet. The first page of the set, or the last page of the set, or both the first page and last page, may comprise cover sheets for the booklet to be formed. The copier/duplicator delivers one set of sheets to be formed into one booklet followed by another set of sheets to be formed into another booklet.

The sheets received from the copier/duplicator can be secured together either by a first adhesive binder generally designated 16 or by a second adhesive binder generally designated 18. Alternatively, the sheets received from the copier/duplicator can be secured together to form a booklet using either a first stapler/finisher generally designated 20 or by a second stapler/finisher generally designated 22. Each of the adhesive binders can be constructed substantially in the manner disclosed in detail in the beforementioned U.S. Pat. No.

4,473,425. Similarly, the stapler/finishers 20 and 22 can be constructed substantially in the manner disclosed in U.S. Pat. No. 4,134,672. Since the disclosure of such patents have been incorporated by reference, the following description of the binders and stapler/finishers will generally describe such apparatus and such patents are referenced for a more complete description of the apparatus.

Sheets passing through slot 14 are delivered to a receiving tray 24 between an edge guide 26, which is engaged by the leading edge of the sheet, and a sheet jogger 28 that is adapted to engage the trailing edge of the sheet and urge the leading edge thereof against the guide 26. A shaft 30 carries a set of drive rollers 32. A puck drive mechanism generally designated 34 comprises a pair of plates 36 journaled on shaft 30, and a rotatable puck 38 that is driven from shaft 30. Ordinarily, the drive puck 38 is located above tray 24 so that it does not interfere with delivery of a sheet S onto the tray. After the sheet has been received on the tray and jogged into alignment by jogger 28, a pneumatic cylinder 40 pivots the puck drive mechanism to move the puck 38 downwardly into engagement with the upper surface of sheet S on tray 24. Puck 38 then drives the sheet toward the rear of the apparatus and into the nip defined by drive rollers 32 and a pair of idler rollers 42 positioned beneath the path of sheet travel.

As the sheet S is driven from tray 24 toward the rear of the apparatus, its left side edge passes beneath an adhesive applicator generally designated 44 so that a line of adhesive can be applied to the left side edge of the upper surface of sheet S. Adhesive is applied to all sheets of a set except the first sheet. Applicator 44 is connected to a cartridge 46 containing liquid adhesive by a conduit 48. Applicator 44 is cycled on and off at the appropriate time in the machine cycle by a logic and control unit (LCU) 49, shown diagrammatically in FIG. 1. The LCU can be dedicated to the control of the finishing apparatus and coupled to a similar logic and control unit for copier/duplicator 12, or a single LCU can be provided for both the copier/duplicator and the finishing apparatus. The LCU receives input data from an operator control panel 51. The use of logic and control units for monitoring and controlling operation of apparatus such as copier/duplicators and finishers is described in more detail in U.S. Pat. Nos. 4,473,425 and 4,134,672, for example.

As a sheet S is driven rearwardly by rollers 32, 42, it engages a curved sheet guide 50 which inverts the sheet. The sheet is driven along the guide by one or more large flexible drive rollers 52. Guide 50 directs the inverted sheet into an assembly tray generally designated 54. The tray 54 has a bottom comprising hinged left and right portions 56 and 58, respectively, so that when a fully assembled booklet B has been formed in the assembly tray the portions 56, 58 can be swung downwardly to allow the booklet to drop onto a sloping sheet guide 60. The force of gravity urges the booklet B along guide 60 and onto a tote tray 62. As explained in U.S. Pat. No. 4,473,425, a tote tray can be mounted so it can be pulled out and removed by the machine operator when a job has been completed.

As sheets are delivered to tray 54, they are jogged to the left, front corner of the tray by sheet joggers (not shown). Such jogging of sheets is disclosed in the before-mentioned U.S. Pat. No. 4,473,425. Each sheet delivered to the tray, except the first sheet, has a line of adhesive thereon along the left side edge of the sheet and on the bottom surface of the sheet as it lies in the tray 54. After each few sheets are delivered to the tray 54, and after the last sheet of a set is delivered to the tray, the left side edges of the sheets are pressed downwardly to facilitate binding of the sheets together by a pressure bar assembly generally designated 64. After the last sheet of a set has been delivered to tray 54, the pressure bar assembly 64 preferably remains in engagement with the set of sheets for a longer period of time than when less than a full set of sheets is located in the tray. As a result, sheets of the following set of sheets cannot be immediately delivered to the tray 54 of adhesive binder 16 as explained hereinbefore. In accordance with the present invention, pressure bar assembly 64 can remain in contact with the set of sheets in tray 54 for a substantial period of time because the next set of sheets to be bound together by adhesive is directed to the second adhesive binder 18. The apparatus for doing this will now be described.

Since binder 18 is substantially identical to binder 16, the same reference characters have been used to designate the same or similar parts in both binders, but the part numbers for binder 18 have a prime (') added.

In order for sheets as received from the copier/duplicator 12 to be delivered to the binder 18, guide 26 of binder 16 is mounted for vertical movement in a slot in tray 24 between the position illustrated in FIG. 1, where it projects above the upper surface of tray 24, and a lowered position beneath the surface of tray 24. Movement between such positions can be accomplished, for example, by a solenoid 66 shown diagrammatically coupled to the guide 26. When the solenoid is energized, the guide is pulled downwardly beneath the surface of tray 24 so that a sheet S delivered to binder 16 moves above the sheet guide 26 and can be advanced across tray 24 of binder 16 to tray 24' of binder 18. The sheet can be propelled in this direction by a puck drive mechanism 68 mounted on a drive shaft 70 and by a plurality of drive rollers 72 carried by shaft 70. This puck drive mechanism can be the same or similar as the puck drive 34 and drive rollers 32 discussed previously. Thus, the puck drive mechanism 68 engages a sheet S and drives it to the drive rollers 72 which in turn propell the sheet to the right across tray 24 and toward binder 18.

Between binders 16 and 18 there is a sheet diverter 74 movable between the solid and dotted lined positions. Normally, the diverter is in the lowered position illustrated in solid lines so that sheets driven to the right by rollers 72 pass over the diverter and are received by tray 24' of binder 18. Sheets are driven across tray 24' by a pair of drive rollers 76 mounted on a drive shaft 78. The sheet jogger 28' of binder 18 also is mounted for movement in a vertical direction between the position illustrated in FIG. 1 and a lowered position wherein it is beneath the surface 24' of binder 18. This can be accomplished by a solenoid 80 shown coupled diagrammatically to the jogger 28'. Thus when the sheet enters binder 18 it is driven by rollers 76 over the lowered jogger 28' and toward the guide 26' of binder 18. After the sheet passes over the jogger, the jogger is raised, jogs the sheet to the right against guide 26' and then puck drive 34' of binder 18 engages the sheet and drives it to the finishing tray 54' past adhesive applicator 44' in the manner described hereinbefore in connection with binder 16. This operation continues until all sheets of set have been deposited in the assembly tray 54' of binder 18, finished in that tray and then dropped onto the guide 60′ of binder 18 for delivery to the tote tray 62. After the second set of sheets has been delivered to the binder 18, the third set of sheets is finished in binder 16 by raising the sheet guide 26 to thereby retain the sheets in binder 16.

When the apparatus is to be used for finishing booklets by applying staples to edge portions of the booklets, solenoids 66 and 80 are energized to lower the sheet guide 26 of binder 16 and jogger 28′ of binder 18. In addition, sheet guide 26′ of binder 18 is moved to a lowered position beneath the surface of tray 24′ by a solenoid 82. This permits sheets to be moved across the surface of tray 24 of binder 16 and tray 24′ of binder 18 for delivery either to the first stapler/finisher 20 or the second stapler/finisher 22. Sheets are driven across the surfaces of trays 24, 24′ by puck drive 68, drive rollers 72 and 76. In addition, a puck drive 84 and a set of drive rollers 86 near the right end of tray 24′ are positioned to receive sheets driven to the right by drive rollers 76 and to propell such sheets off of the right end of the tray 24′. The sheets are delivered either to the finisher 20 or finisher 22 by manipulation of the sheet diverter 74 between its solid line position, which allows sheets to be delivered to finisher 22, and its dotted line position which directs sheets to the finisher 20.

When diverter 74 is in its raised position, sheets driven across tray 24 of binder 16 are deflected by the diverter into a slot between the diverter and a drive roller 88. Roller 88 drives the sheets onto a curved sheet guide 90 that has its lower edge adjacent the right side of the assembly tray 54. Sheets are propelled from the lower end portion of guide 90 into tray 54 by a pair of drive rollers 92 located along the lower edge portion of guide 90. As the sheets enter the tray 54, they are jogged to the right front corner of the tray, or to the left front corner as explained hereinbefore. When all sheets of a set have been received into the tray 54, the sheets are secured together into a booklet by applying one or more staples to the booklet. This is accomplished by actuating one or more of staplers 94 located above the surface of tray 54 by a distance sufficient to allow the sheets S to pass along guide 90 and into the tray 54 under the staplers. By way of example, the staplers can be of the type that form staples from a continuous wire, as described in the before-mentioned U.S. Pat. No. 4,134,672, or they can be electrically operated staplers that receive preformed staples. When sheets of the set have been secured together by one or more staples, tray portions 56, 58, swing downwardly to drop the booklet onto the guide 60 and allow it to be delivered to the tote tray 62.

As soon as the last sheet of one set has passed beneath diverter 74, the diverter swings to its lowered, solid line position so that the first sheet of the next set of sheets passes above the diverter and is driven by drive rollers 76, puck drive 84 and drive rollers 86 to the second stapler/finisher 22. Stapler/finisher 22 is substantially the same as finisher 20, and accordingly, the same reference numerals have been used with the addition of a prime being added to such numerals to distinguish them from the finisher 20. Finisher 22 comprises a sheet guide 96 that preferably has an upper portion **96*a* that projects above the level of the surface of tray 24′. Portion 96*a* of the guide thus is effective to deflect the sheet traveling across tray 24′ downwardly between the drive roller 88′ and the sheet guide 96 for delivery of the sheet to assembly tray 54′. Thus a separate sheet diverter such as shown as 74, need not be provided for the stapler/finisher 22. In other respects, the finisher 22 can be the same as the finisher 20**.

While two staplers 94 are illustrated for each finisher 20, 22, one stapler can be provided for each finisher. When a single stapler is provided, it can be indexed to two or more positions along the edge of a set of sheets to staple the sheets together at a plurality of positions. There is sufficient time available for indexing a stapler in this manner because the next set of sheets will be provided to the other stapler/finisher.

Figure 2:
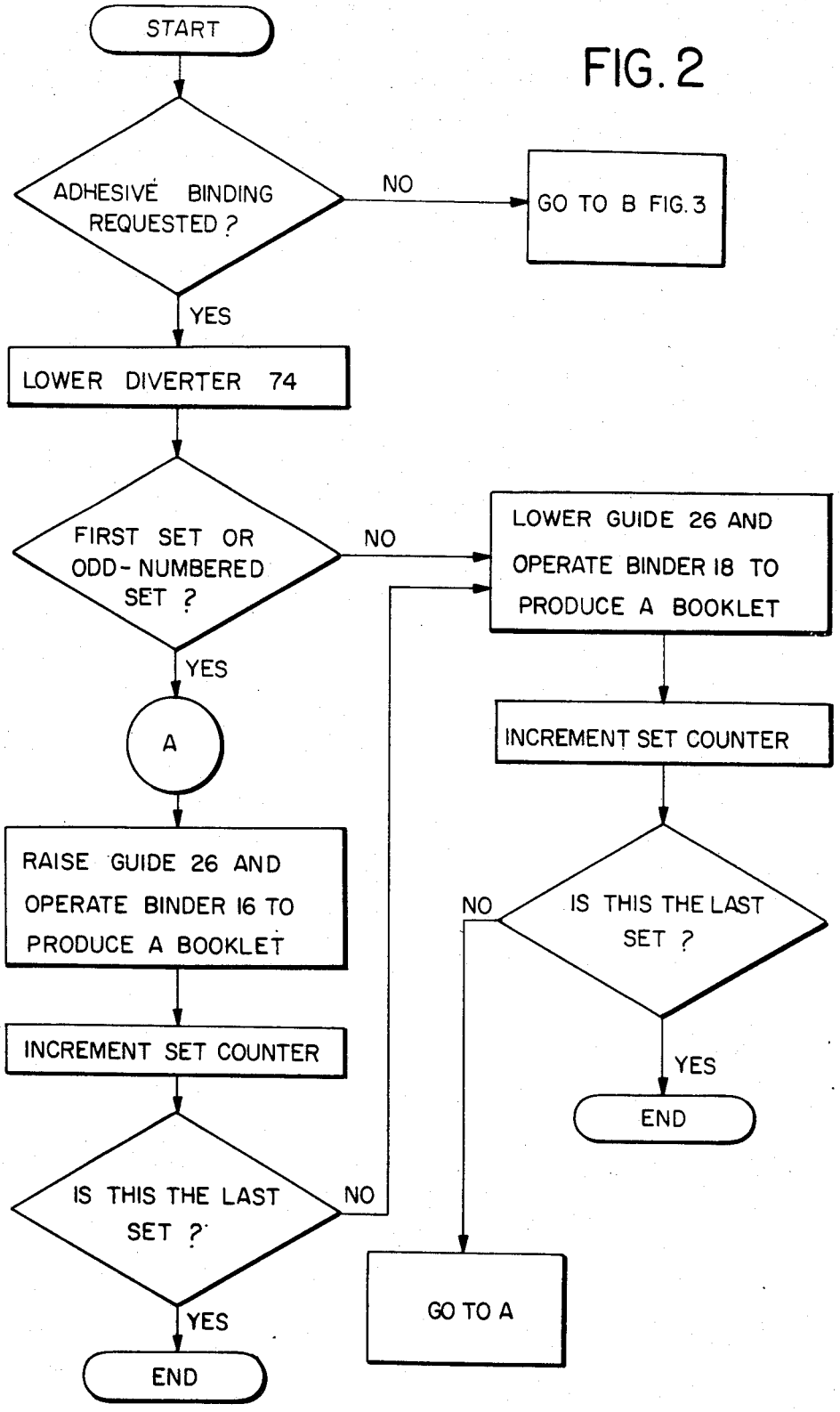
FIGS. 2 and 3 are flow charts graphically illustrating operation of the apparatus of the invention.

In describing the operation of the apparatus of the invention, reference will be made not only to FIG. 1, but also to the flow diagrams in FIGS. 2 and 3.

When booklets are to be produced using the apparatus of the invention, the machine operator will provide cerain inputs to the LCU 49 by using the operator control panel 51 of the copier/duplicator. Such inputs will indicate the number of booklets to be produced, the manner in which the sets are to be finished; i.e., are they to be adhesively bound together or finished by stapling, and any other information required for completion of the job. When that information has been provided to the logic and control unit through the operator control panel, the the copier/duplicator is started and sets of copies are furnished seriatim to the finisher 10 through slot 14.

The logic and control unit will first determine if adhesive binding has been requested by the machine operator. Referring to FIGS. 1 and 2, if the answer to that question is yes, then the diverter 74 is moved to its lowered (solid-line) position so that sets of sheets can be delivered alternately to binder 16 and binder 18. The logic and control unit will keep track of sets of sheets delivered to the finisher and thus will determine if the set of sheets being delivered is the first set of sheets or another odd numbered set of sheets. If the answer is yes, then the guide 26 is raised and binder 16 is operated to produce a booklet in assembly tray 54 and deliver that booklet to the tote tray 62.

After the last sheet of a set of sheets passes through slot 14, the logic and control unit will increment a set counter in the LCU and determine if the set just delivered to apparatus 10 is the last set requested by the apparatus operator. If the answer is yes, then the machine is shut down or placed on standby. If the answer is no, then guide 26 is lowered and binder 18 operated to produce another booklet. When the last sheet of that set enters the apparatus through slot 14, the logic and control unit will increment the set counter and determine if the set just delivered is the last set to be produced. Again, if the answer to that question is yes, the apparatus is shut down or placed on standby. On the other hand, if the set produced in binder 18 is not the last set, then the logic and control unit returns to "A" to produce another set using binder 16. This procedure is repeated, alternately producing a booklet using binder 16 and then binder 18, until the requested number of booklets have been completed.

Figure 3:
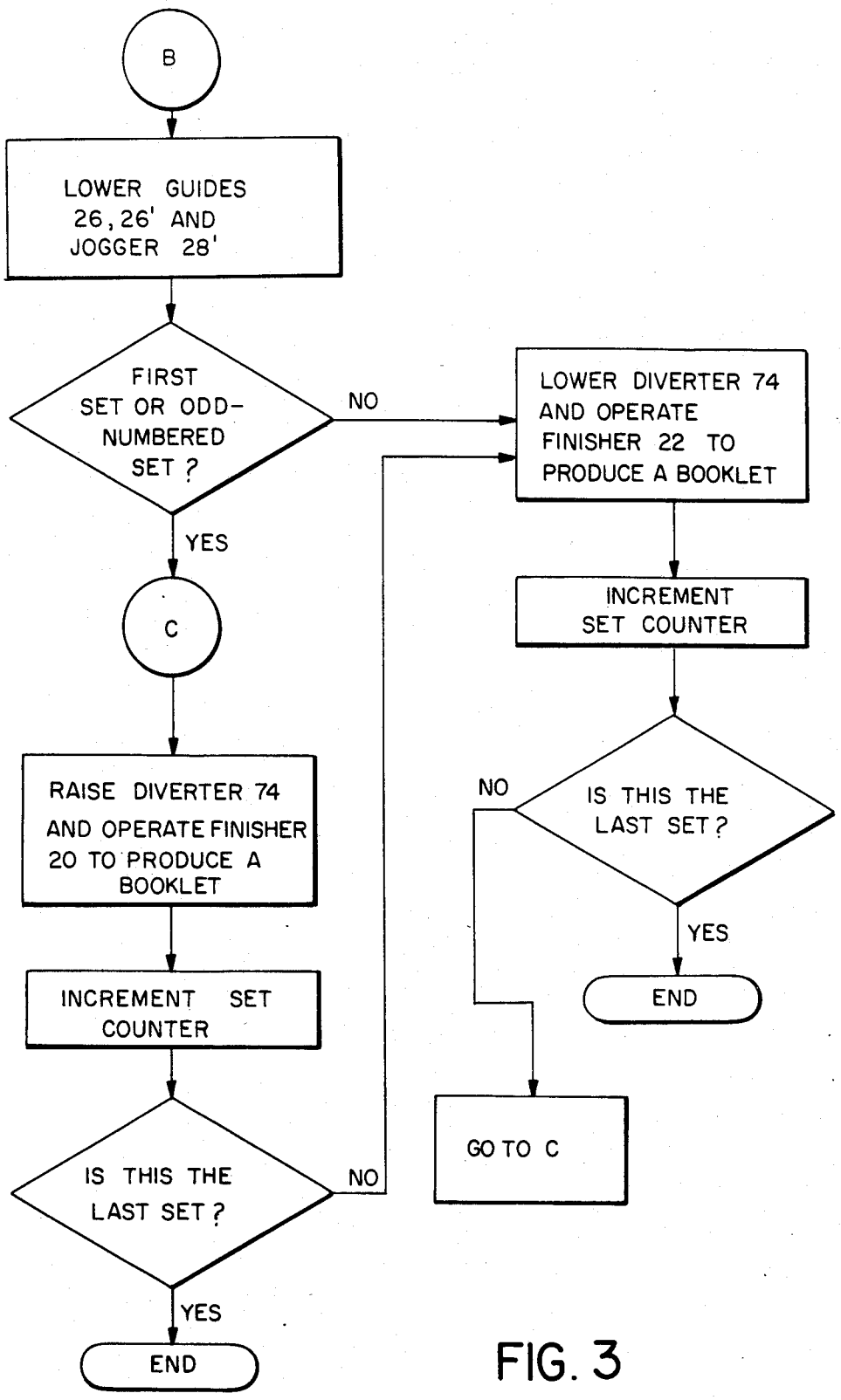

If the machine operator has not requested adhesive binding of booklets, then the operation proceeds as shown by the flow diagram in FIG. 3. More specifically, sheet guides 26, 26′ and jogger 28′ are lowered so that sheets entering the finisher 10 can be directed to either the stapler/finisher 20 or the stapler/finisher 22. The logic and control unit determines whether the set of sheets being delivered to the apparatus 10 is the first set or another odd-numbered set of sheets. If the answer is yes, then diverter 74 is raised and stapler/finisher 20 is operated to produce a booklet. As the last sheet of a set is delivered from copier/duplicator 12, the LCU increments a set counter and determines if the set thus delivered is the last set requested by the operator. If the answer is yes, then the apparatus is placed on standby or shut down. If the answer is no, then diverter 74 is lowered so that the first sheet of the next set delivered to the apparatus 10 moves across trays 24, 24' and thus delivered to stapler/finisher 22. As the last sheet of the set is delivered to finisher 22, the LCU increments the set counter and determines if the set thus delivered is the last set requested by the operator. Again, if the answer is yes, the machine is placed on standby or shut down. If the answer is no, then diverter 74 is raised again and stapler/finisher 20 operated to produce the next booklet. This sequence continues until all of the requested sets have been finished.

A number of advantages are achieved by the apparatus of the invention. First of all, the apparatus can be operated on an "on-line basis" with the associated copier/duplicator. There is sufficient time for completion of production of booklets in the binders or stapler/finishers without requiring the associated copier/duplicator to be stopped briefly between sets of sheets. The invention also eliminates the need for mechanisms that delay the delivery of the initial sheets of one set until the preceding set has been completely finished in the assembly tray. Moreover, by having substantially redundant binders and substantially redundant stapler/finishers, a machine operator can continue to produce booklets even when some part of the finishing apparatus 10 is temporarily disabled. For example, if one of the adhesive binders is inoperative, apparatus 10 can still be used for producing booklets by using the stapler/finishers. Similarly, adhesive binding operations can continue when one of the stapler/finishers is temporarily disabled. In addition, even if one adhesive binder is disabled, the apparatus 10 can be programmed to operate on a delayed feed basis so that there is a slight delay between sets of sheets. Such can be accomplished automatically by pre-programming the LCU, or manually by use of the operator control panel 51. This will allow the operative adhesive binder to be used to produce booklets. While this is less desirable, as explained hereinbefore, it is better than being unable to produce booklets at all. Booklets produced by both adhesive binders and by both stapler/finishers are furnished to a common tray 62. This reduces the complexity of the apparatus and simplifies its use by an operator.

In addition, it will be observed that the staplers 94 are at the side edge of the assembly trays opposite from the edge where adhesive is present on sheets. Thus the staplers do not become contaminated with adhesive.

The invention has been described in detail with particular reference to a preferred embodiment thereof, but it will be understood that variations and modifications can be effected within the spirit and scope of the invention.

I claim:

1. Apparatus for receiving one or more sets of sheets with each sheet having one side edge to be bound to other sheets of a set to form a booklet, the apparatus comprising:

an assembly tray having first and second spaced sides;

means for feeding a set of sheets to the tray along a first sheet path that locates the one side edge of each sheet along the first side of the tray;

means for feeding a set of sheets along a second sheet path that locates the one side edge of each sheet along the second side of the tray;

means for directing sheets along the first sheet path or the second sheet path;

means for aligning the one side edge of sheets fed to the tray along the sheet paths;

means located along the first path for applying adhesive to the one side edge of sheets fed along the first path;

means located adjacent the second side of the tray for applying a staple to a set of sheets fed to the tray along the second path; and control means for operating the adhesive applying means when sheets are directed along the first sheet path and for operating the staple applying means when sheets are directed along the second sheet path.

2. Apparatus for producing a plurality of booklets with each booklet comprising a set of sheets fed seriatim to the apparatus, the apparatus comprising:

first and second adhesive binders for securing sheets of a set of sheets together with adhesive to form a booklet, each of the adhesive binders comprising an assembly tray for receiving sheets fed seriatim to the tray, means for aligning sheets in the tray, and means for applying adhesive to the sheets; first and second stapler/finishers for securing sheets of a set of sheets together with one or more staples to form a booklet, the first stapler/finisher comprising means for stapling together sheets in the assembly tray of the first adhesive binder, the second stapler/finisher comprising means for stapling together sheets in the assembly tray of the second adhesive binder;

means for (1) alternately directing sets of sheets to the first adhesive binder and to the second adhesive binder or (2) alternately directing sets of sheets to the first stapler/finisher and the second stapler/finisher;

means for selectively operating either the adhesive applying means of the first and second binders or the stapling means of the first and second stapler finishers; and means for collecting finished booklets from the binders and the finishers.

* * * * *